US006317042B1

(12) United States Patent
Engelhorn et al.

(10) Patent No.: US 6,317,042 B1
(45) Date of Patent: Nov. 13, 2001

(54) AUTOMATED EMERGENCY ANNOUNCEMENT SYSTEM

(75) Inventors: Sandi LaVonne Engelhorn, Lyons, CO (US); Chinmei Chen Lee; Zhibi Wang, both of Woodridge, IL (US)

(73) Assignee: Lucent Technologies Inc., DE (US)

( * ) Notice: Subject to any disclaimer, the term of this patent is extended or adjusted under 35 U.S.C. 154(b) by 0 days.

(21) Appl. No.: 09/562,885

(22) Filed: May 1, 2000

(51) Int. Cl.[7] ..... G08B 1/08

(52) U.S. Cl. ..... 340/539; 340/506; 340/531; 340/533; 340/288; 340/825.06; 340/825.24; 340/825.36; 340/825.47; 340/825.52

(58) Field of Search ..... 340/506, 531, 340/532, 533, 539, 287, 288, 825.06, 825.07, 825.24, 825.47, 825.25, 825.36, 825.37, 825.52

(56) References Cited

U.S. PATENT DOCUMENTS

| | | | | |
|---|---|---|---|---|
| 4,389,639 | * | 6/1983 | Torii et al. | 340/531 |
| 4,673,920 | * | 6/1987 | Ferguson et al. | 340/531 |
| 5,189,394 | * | 2/1993 | Walter et al. | 340/506 |
| 5,252,775 | * | 10/1993 | Urano et al. | 340/506 |
| 5,654,690 | * | 8/1997 | Ishikawa et al. | 340/506 |

* cited by examiner

*Primary Examiner*—Daryl Pope
(74) *Attorney, Agent, or Firm*—Reginald J. Hill; R. J. Hill & Associates

(57) ABSTRACT

In response to an emergency event, an emergency announcement system (100) causes display of an escape route based upon a room location. A sensor (104) detects an emergency event. The sensor data (106) from the sensor relating to the emergency event is transmitted to an emergency server (122), the emergency server (122) determines the escape route and the escape route is sent to a display device (118) for use by the building occupants to escape the emergency.

5 Claims, 3 Drawing Sheets

AUTOMATED EMERGENCY ANNOUNCEMENT SYSTEM

FIELD OF THE INVENTION

The invention relates generally to emergency announcement systems for occupied buildings, and in particular, to an emergency announcement system that displays an escape route for occupants of a building.

BACKGROUND OF THE INVENTION

When an emergency situation occurs in an occupied building, the people present may not know the best way to avoid danger. For example, a hotel guest sleeping at night may be startled at the sound of a fire alarm. Following the alarm, the guest needs to determine the best route for escape, with the fire escape sign on the back of the hotel door providing the only guidance. Generally, the guest requires more information about the emergency to increase the odds of escaping successfully and to prevent the loss of life.

Current emergency systems do not tell people in a building the best way to escape when an emergency situation occurs. Standard emergency systems only sound a loud alarm, which may cause people to panic because of the lack of information about their situation. Additionally, the best escape route may vary for different locations in the building and the site of the emergency situation. Current emergency systems do not account for this possibility.

The current state of the art for an emergency system for a building consists of two components: detection of an emergency and notification that an emergency exists. A smoke detector demonstrates the two-step approach: the sensor on the detector senses a fire and then the detector's alarm sounds. The information provided by the alarm does not convey enough information to people on how to escape the emergency.

Therefore, a need exists for a system that can quickly inform people about the best escape route in a simple fashion.

SUMMARY OF THE INVENTION

A method is provided for alerting building occupants of an emergency situation and an escape route. The method includes the steps of sensing an emergency, alerting the occupants in the building about the emergency, determining the best escape route for an occupant's location, and displaying the escape route.

An apparatus is provided for alerting building occupants of an emergency situation and the appropriate escape route. The apparatus includes a sensor for sensing an emergency; an alarm system for notifying building occupants about the emergency; an emergency server for determining an emergency route based upon an occupant's location and the location of the emergency; and a display device for displaying the escape route.

DETAILED DESCRIPTION OF THE PREFERRED EMBODIMENTS

Figure 1:
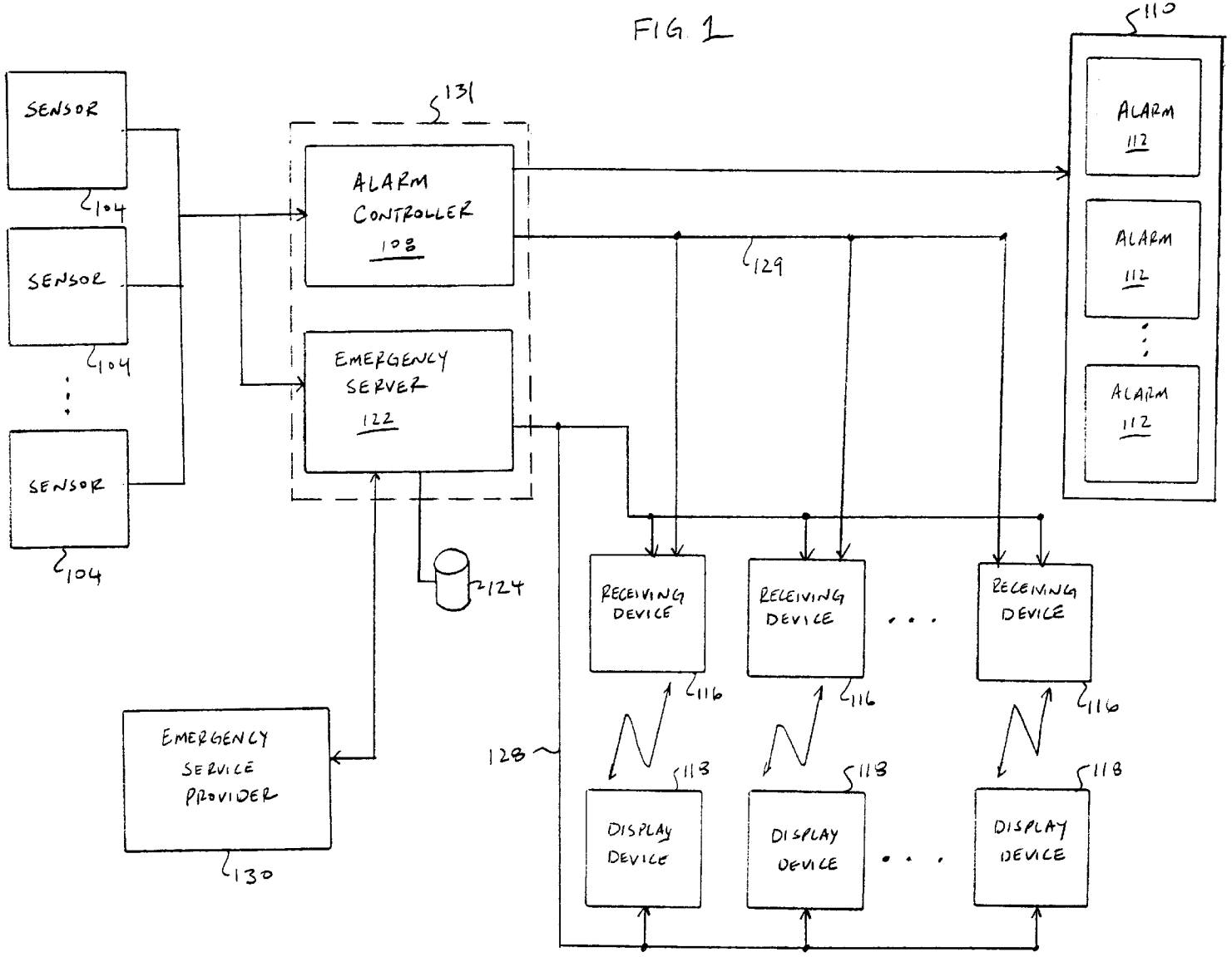
FIG. 1 is a block diagram of a system that implements a method in accordance with the present invention.

FIG. 1 is a block diagram of a preferred embodiment of an automated emergency announcement system 100 in accordance with the present invention. The system 100 includes an alarm controller 108 and an emergency server 122. Alarm controller 108 is coupled to sensors 104, which detect an emergency situation. Alarms 112, which form an alarm distribution network 110, are coupled to alarm controller 108 to alert occupants of a building that an emergency is occurring. Sensors 104 are also coupled to emergency server 122 to alert emergency server 122 of the details of an emergency event. Emergency server 122 determines the escape routes for emergency events. More specifically, emergency server 122 is coupled to a room location database 124, which stores location information for the rooms of an occupied building. With reference to the room location database 124, emergency server 122 computes the escape routes necessary to avoid an emergency event.

Alarm controller 108 and emergency server 122, in response to receiving an indication of an emergency event, alert building occupants of the emergency and provide an escape route that is dependent on the occupant's location and the location of the emergency event. In particular, alarm controller 108 and emergency server 122 control the communication of an escape route to occupants via receiving devices 116 and display devices 118. Display devices 118 visually and/or audibly communicate the method of escape. Display devices 118 and receiving devices 116 are preferably dispersed throughout the occupied building in locations where occupants are likely to be. For example, if the occupied building is a hotel, at least one receiving device and display device is in each room of the hotel. Receiving devices 116 and display devices 118 are coupled to emergency server 122 by a network 128. Similarly, receiving devices 116 are coupled to alarm controller 108 by a network 129.

Emergency server 122 preferably includes a computer to process sensor data via a computer algorithm. Emergency server 122 generates escape routes utilizing sensor data and room location database 124. Emergency server 122 is optionally coupled to an emergency service provider 130 to directly communicate an emergency event and the escape routes of occupants to the emergency service provider.

Alarm controller 108 preferably includes a computer. Alarm controller 108 controls alarm distribution network 110 to sound alarms 112. Also, alarm controller 108 generates a signal that is received by receiving device 116 and used to turn on display devices 118 to receive an escape route. Most preferably, the alarm controller 108 is integrated with emergency server 122, into an emergency alarm server 131, as shown in FIG. 1. This arrangement advantageously reduces the number of interfaces to sensors, alarms, receiving devices and display devices.

Room location database 124 preferably contains the room positions throughout a building. Room location database 124 and emergency server 122 generate a unique escape route 126 based upon sensor data 106 and the room location of display devices 118. That is, emergency server 122 may generate as many escape routes as there are locations, the locations being determined and distinguished generally by display devices 118.

Sensors 104 are preferably devices that detect an emergency event. For example, sensors 104 may sense the smoke that results from a fire or the nuclear radiation resulting from a nuclear leak from an internal or external source. Sensors 104 generate sensor data about an emergency event. The sensor data preferably includes information about the type and location of an emergency event. Typically the location of an emergency event is inferred from the location of the sensor 104 detecting the event. Sensors 104 are dispersed throughout the occupied building. Optionally, the sensors 104 are placed on the outside of a building's rooms to detect an external emergency event.

Alarms 112 are devices capable of generating audio or visual indicators. Alarm distribution network 110 may be a pre-existing alarm system present in a building that is linked to alarm controller 108. Alarms 112 preferably are loud audio devices with optional light flashes or other visual indications. Alarm controller 108 controls alarm distribution network 110 to turn on alarms 112 to indicate an emergency event. In embodiments where there are no pre-existing alarms or alarm distribution network, alarms 112 are preferably integrated with receiving devices 116.

Display device 118 is preferably a television adapted to be remotely controlled by receiving device 116 or controlled by emergency server 122 over network 128. Alternatively, another display device, such as a computer display, controlled in an analogous manner, is used. The escape route that is communicated or displayed by display device 118 preferably contains visual and audible information for assisting building occupants to escape an emergency situation. Alternatively, the escape route is only announced through an audio device, for example, using a voice synthesizer.

Receiving devices 116 are devices that can receive a signal and in response thereto turn on a display device 118 to receive an escape route. In one embodiment receiving devices 116 merely turn on display devices 118 (if not already on) and direct display devices 118 to receive an escape route, for example, over a predetermined television channel over network 128. In an alternate embodiment, receiving devices 116 also each receive an escape route from emergency server 122 and, in addition to turning on the display device, transmit the escape routes to display devices 118. In yet another embodiment, receiving devices 116 are not necessary and emergency server 122 directly controls display devices 118 over network 128 to turn on and display the escape route applicable to the display device. In embodiments where receiving devices are used, receiving devices 116 and display devices 118 preferably conform to the BLUETOOTH standard, which allows compatible devices to communicate via a wireless interface.

An emergency contingency may arise when the path to an escape exit is blocked. By having a plurality of escape routes, the building occupants may have an additional way to avoid danger. Sensors 104 are disposed at exits and other key positions that continually update the emergency server 124 about the status of escape routes. The emergency server 122 may determine an updated escape route that is communicated to the building occupants via display devices 118 if a previous method of escape becomes hazardous, for example, by the spread of a fire.

Figure 2:
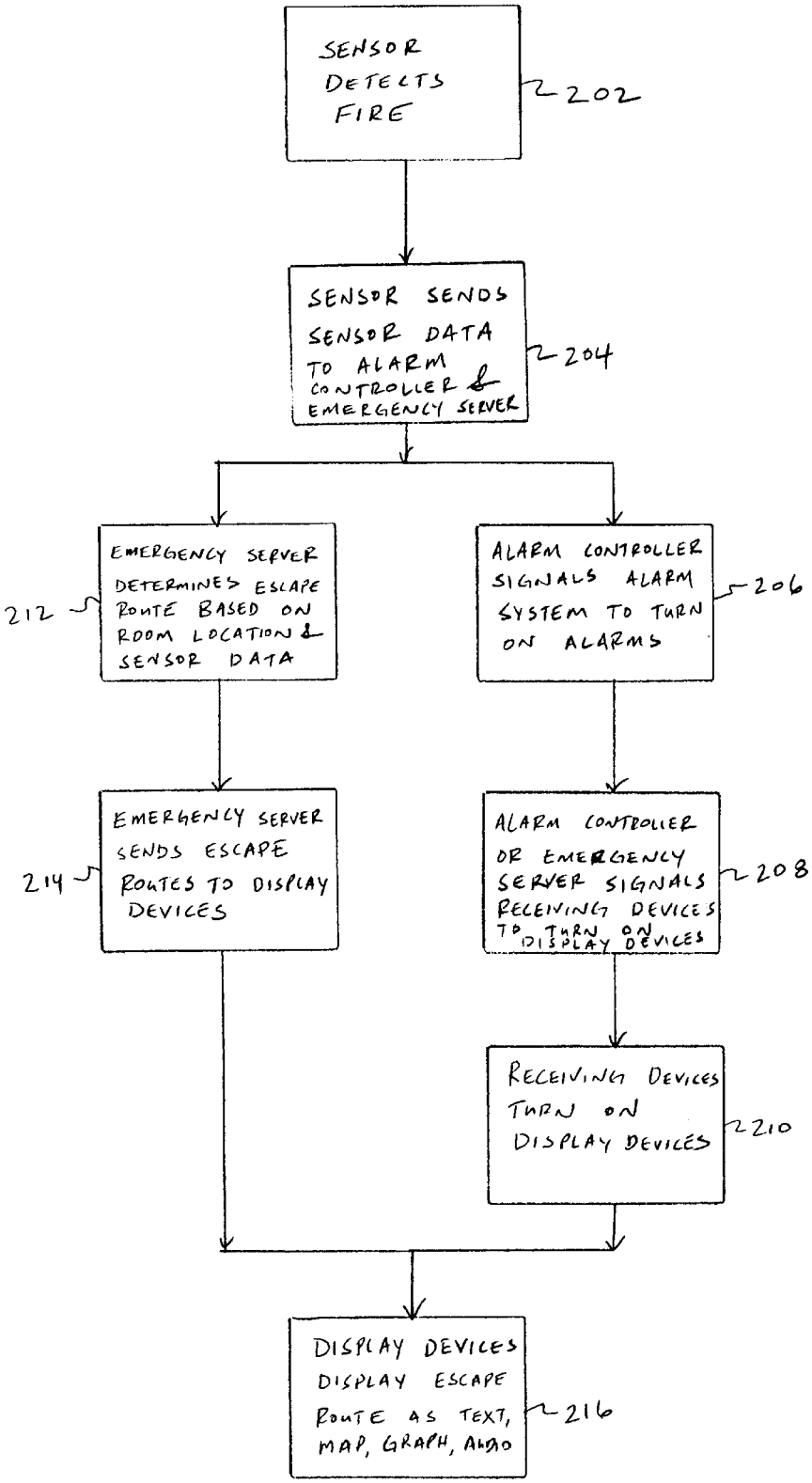
FIG. 2 is a flow chart of a preferred embodiment in accordance with the present invention.

FIG. 2 is a flow chart illustrating a method for alerting building occupants of an emergency situation in accordance with the present invention. FIG. 2 is described below with reference to system 100 of FIG. 1.

First, a sensor 104 detects an emergency event, in this case a fire (202). Sensor 104 then sends sensor data to the alarm controller 108 and the emergency server 122 (204). The sensor data preferably includes data regarding the location and characteristics of the emergency event. In most cases, since sensors 104 are fixed at a certain location, the location of the emergency event is implicit. The characteristics of the event may include for example the amount of smoke, the amount of radiation, the temperature and other factors that may be useful.

The alarm controller 108 sends out an alert to the alarm distribution system 110 to turn on the alarms 112 (206). Preferably, the alarm controller 108 selectively triggers all or some of the alarms 112 as necessary to alert those affected by the emergency situation. Then the alarm controller 108 sends a signal to the appropriate receiving devices 116 to turn on the corresponding display devices 118 (208).

The receiving devices 116 preferably turn on the display devices 118 by sending a signal over the air using a wireless interface (210). Alternatively, display devices 118 are turned on directly by emergency server 122. Once activated, display devices 118 display information for the building occupants indicating that an emergency situation exists and that further instructions will follow. The display preferably includes audible instructions.

Emergency server 122 determines escape routes with reference to the room location database 124 and sensor data (212). More specifically, based on the location of the emergency event, the potential location of occupants (as determined by the location of the display devices), and the location of available exits, emergency server 122 computes an escape route for each potential location of occupants. Preferably, the escape route is computed using artificial intelligence technology.

Emergency server 122 sends the escape routes to the display devices 118 (214). Depending on the arrangement of system 100, there are alternatives for communicating the escape route to the display devices 118. Where receiving devices 116 and display devices 118 are capable of wireless communication with sufficient bandwidth, the escape routes are sent to receiving devices 116 for wireless transmission to display devices 118. Where receiving devices 116 and display devices 118 do not have sufficient wireless bandwidth for wireless transmission of the escape routes, or where receiving devices 116 are not employed, the escape route is transmitted to the display device via network 128.

Figure 3:
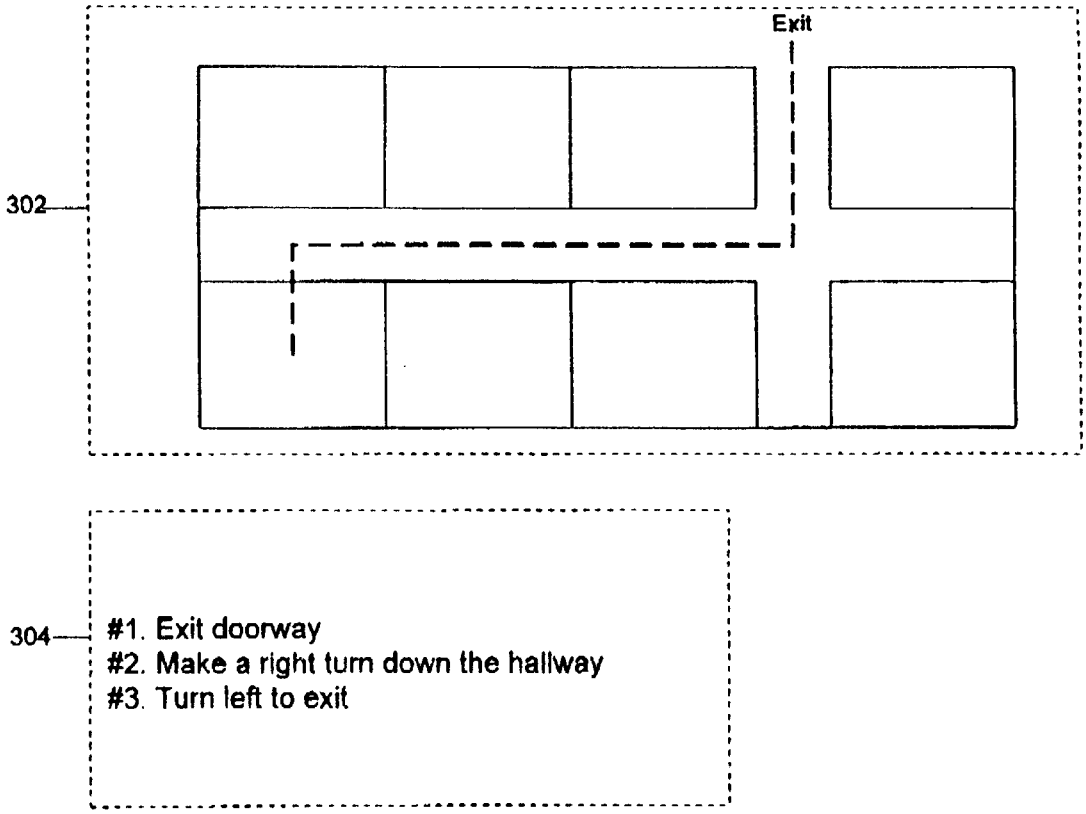
FIG. 3 is an example of escape route information displayed on an emergency display device in accordance with the present invention.

Finally, the display devices 118 display the escape routes (216). An example escape route is shown in FIG. 3 on a display device 118. Preferably, each escape route is displayed as a color-coded map 302 with diagrams and text 304. Alternatively, a room-based printer provides a hardcopy of the map if the display device either supports a printer or is a computer with a printer. Most preferably, the display device provides audio instructions that supplement the escape route map.

In accordance with the present invention the occupants of a building are readily informed of an emergency event and of a custom escape route for exiting the building and avoiding the emergency situation. Advantageously, the custom escape route, which is communicated audibly and visually, improves an occupant's chances of surviving an emergency situation.

The invention being thus described, it will be evident that the same may be varied in many ways. Such variations are not to be regarded as a departure from the spirit and scope of the invention and all such modifications are intended to be included within the scope of the appended claims.

What is claimed is:

1. A method for providing a plurality of escape routes for a plurality of room locations, the method comprising the steps of:

A) at least one sensor of a plurality of sensors detecting an emergency event;

B) the at least one sensor transmitting to an emergency server a sensor data relating to the emergency event;

C) the emergency server determining an escape route for each room location of the plurality of room locations based upon a position of the at least one sensor;

D) the emergency server transmitting the escape route for each room location of the plurality of room locations to a display device located at the each room location;

E) the display device located at the each room location communicating the escape route for each room location;

F) a first sensor of the plurality of sensors detecting a change in the emergency situation;

G) the first sensor generating a changed sensor data reflecting the change in the emergency situation;

H) the emergency server receiving the changed sensor data;

I) the emergency server determining an alternative escape route for at least one room location of the plurality of room locations, the alternative escape route reflecting the change in the emergency situation;

J) the emergency server transmitting the alternative escape route to a display device located at the at least one room location; and K) the display device communicating the alternate escape route to building occupants.

2. The method of claim 1 wherein the display device comprises one of a television and a computer.

3. The method of claim 1 further comprising printing the escape route.

4. The method of claim 1 further comprising the step of the emergency server turning on the display device prior to transmitting the escape route.

5. The method of claim 1 wherein the emergency server is coupled to the display device by a wireless interface.

* * * * *